US010485090B2

(12) United States Patent
Myneni

(10) Patent No.: US 10,485,090 B2
(45) Date of Patent: Nov. 19, 2019

(54) HIGH PERFORMANCE SRF ACCELERATOR STRUCTURE AND METHOD

(71) Applicant: JEFFERSON SCIENCE ASSOCIATES, LLC, Newport News, VA (US)

(72) Inventor: Ganapati Rao Myneni, Yorktown, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 434 days.

(21) Appl. No.: 15/411,986

(22) Filed: Jan. 21, 2017

(65) Prior Publication Data

US 2017/0215268 A1 Jul. 27, 2017

Related U.S. Application Data

(60) Provisional application No. 62/281,846, filed on Jan. 22, 2016.

(51) Int. Cl.
*H05H 7/20* (2006.01)

(52) U.S. Cl.
CPC ..... *H05H 7/20* (2013.01)

(58) Field of Classification Search
CPC ..... H05H 7/20
USPC ..... 505/230
See application file for complete search history.

(56) References Cited

U.S. PATENT DOCUMENTS

| | | | | |
|---|---|---|---|---|
| 4,127,452 | A | 11/1978 | Martens | |
| 4,765,055 | A | 8/1988 | Ozaki et al. | |
| 6,097,153 | A | 8/2000 | Brawley et al. | |
| 8,128,765 | B2 | 3/2012 | Myneni et al. | |
| 8,731,628 | B1 | 5/2014 | Agassi et al. | |
| 9,006,147 | B2 | 4/2015 | Taylor et al. | |
| 9,343,649 | B1 | 5/2016 | Cooper | |
| 9,352,416 | B2 | 5/2016 | Khare et al. | |
| 2012/0094839 | A1* | 4/2012 | Khare | B23K 26/0823 505/210 |
| 2012/0144890 | A1* | 6/2012 | Miyasaka | C21D 7/06 72/53 |
| 2017/0006695 | A1 | 1/2017 | Jain et al. | |

* cited by examiner

*Primary Examiner* — Paul A Wartalowicz

(57) ABSTRACT

A high performance accelerator structure and method of production. The method includes precision machining the inner surfaces of a pair of half-cells that are maintained in an inert atmosphere and at a temperature of 100 K or less. The method includes removing thin layers of the inner surfaces of the half-cells after which the roughness of the inner surfaces in measured with a profilimeter. Additional thin layers are removed until the inner surfaces of the half-cell measure less than 2 nm root mean square (RMS) roughness over a 1 $mm^2$ area on the profilimeter. The two half-cells are welded together in an inert atmosphere to form an SRF cavity. The resultant SRF cavity includes a high accelerating gradient ($E_{acc}$) and a high quality factor ($Q_0$).

7 Claims, 3 Drawing Sheets

Figure 2. Elongation at break vs. temperature.

HIGH PERFORMANCE SRF ACCELERATOR STRUCTURE AND METHOD

CROSS-REFERENCE TO RELATED APPLICATIONS

This application claims the benefit of Provisional U.S. Patent Application Ser. No. 62/281,846 filed Jan. 22, 2016.

GOVERNMENT LICENSE RIGHTS STATEMENT

The United States Government may have certain rights to this invention under Management and Operating Contract No. DE-AC05-06OR23177 from the Department of Energy.

FIELD OF THE INVENTION

The present invention relates to superconducting radio frequency (SRF) cavities and more particularly a method of producing SRF cavities having both high accelerating gradients and a high quality factor.

BACKGROUND OF THE INVENTION

Currently there are available techniques for producing SRF cavities with a high accelerating gradient and additional techniques for producing SRF cavities with a high quality factor. Unfortunately, there are no available techniques for producing SRF cavities with both a high accelerating gradient ($E_{acc}$) and with a high quality factor ($Q_0$). The meaning of the term "high accelerating gradient ($E_{acc}$)" as used herein is an accelerating gradient ($E_{acc}$) of 45 MV/m or greater. The meaning of the term "high quality factor ($Q_0$)" as used herein is a quality factor of $4\times10^{10}$ or greater.

The performance of SRF cavities depend on the process and procedures used in the fabrication of the cavities. Present day methods used barrel polishing, buffer chemical polishing, electro polishing, or a combination of these to remove the surface damage layer that takes place during the preparation of the niobium (Nb) discs and/or deep drawing of half-cells that are welded together to fabricate multi-cell cavities. Unfortunately, these methods tend to produce a damage layer within the niobium cavity which limits the ability to achieve a high $Q_0$. Additionally, chemical polishing loads the cavities with performance degrading hydrogen.

Using high Residual Resistivity Ratio (RRR) niobium with present techniques it is possible to construct accelerator structures with gradients up to about 42 MV/m but low $Q_0$. Under present methods, alloying with nitrogen and titanium improves the $Q_0$ but unfortunately lowers the $E_{acc}$.

Accordingly, what is needed is a method for producing high performance accelerator structures, such as SRF cavities, that exhibit a high quality factor ($Q_0$) as well as high accelerating gradients ($E_{acc}$). Furthermore, the method should be capable of producing accelerator structures having high $Q_0$ and $E_{acc}$ cavities at reduced cost in a sustainable way using ingot niobium with relaxed specifications.

OBJECT OF THE INVENTION

The first object of the invention is to provide a method for producing SRF cavities with both high accelerating gradients and with a high quality factor.

The second object of the invention is to provide a method for producing SRF cavities which eliminates or effectively removes the damage layer from the niobium cavity.

A further object of the invention is to provide a process for producing SRF cavities that excludes all the chemical processes that introduce hydrogen into the cavities.

A further object of the invention is to provide a means of producing high $Q_0$ and high $E_{acc}$ cavities at reduced cost in a sustainable way using ingot niobium with relaxed specifications.

Another object is to enable the production of SRF cavities using ingot niobium of lower purity, thereby making this technology economical and efficient for industrial, nuclear energy and discovery science programs.

These and other objects and advantages of the present invention will be better understood by reading the following description along with reference to the drawings.

SUMMARY OF THE INVENTION

The present invention is a high performance accelerator structure and method of production. The method includes precision machining the inner surfaces of a pair of half-cells that are maintained at a temperature of 100 K or less. The method includes removing thin layers of the inner surfaces of the half-cells after which the roughness of the inner surfaces in measured with a profilimeter. Additional thin layers are removed until the inner surfaces of the half-cell measure less than 2 nm root mean square (RMS) roughness over a 1 $mm^2$ area on the profilimeter. The two half-cells are welded together to form an SRF cavity. The resultant SRF cavity includes an accelerating gradient ($E_{acc}$) of 45 MV/m or greater and a quality factor ($Q_0$) of $4\times10^{10}$ or greater.

DETAILED DESCRIPTION

Figure 1:
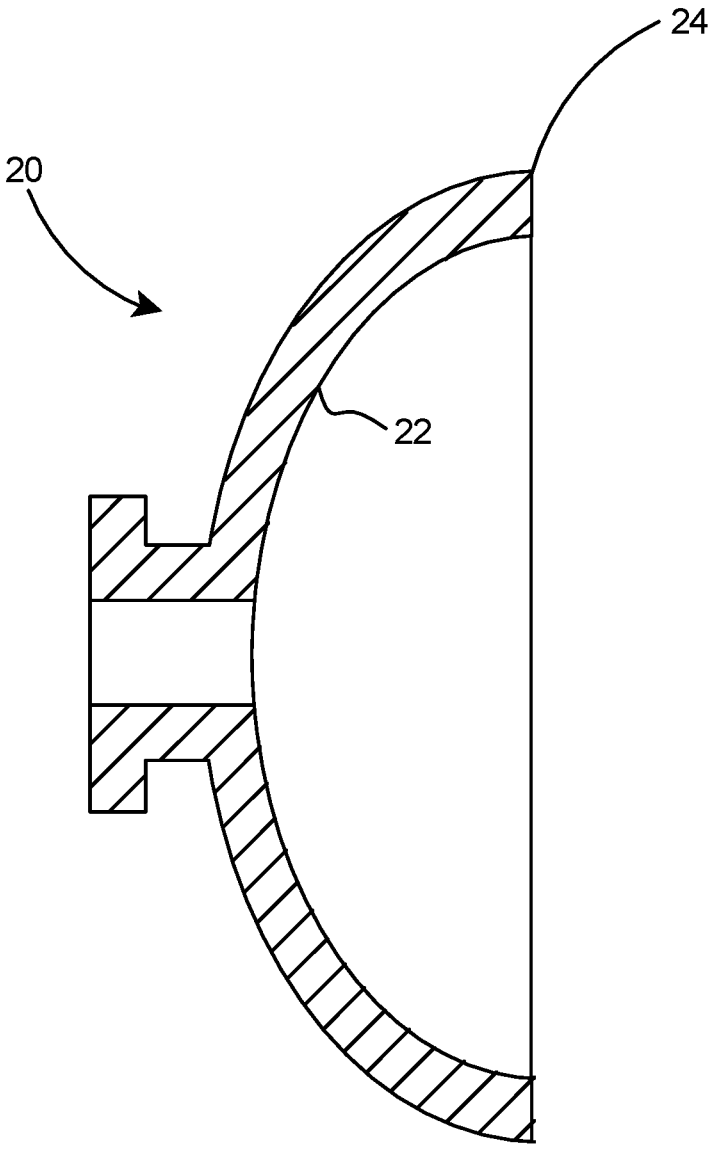
FIG. 1 is a sectional view of a half-cell used for forming an accelerator structure according to the present invention.

The present invention is a method for producing high performance accelerator structures, such as SRF cavities, with high a quality factor ($Q_0$) as well as high accelerating gradients ($E_{acc}$) using ingot niobium with relaxed specifications. The method eliminates the use of chemical polishing which loads the cavities with performance-degrading hydrogen.

SRF cavities quench at high magnetic field region (near the equator) due to first flux penetration where residual stresses are high and copious hydrogen is present. Magnetic flux reduces thermal conductivity and increases specific heat there by considerably reducing the thermal diffusivity. Thermal conductivity and specific heat data for niobium varies with different interstitials (purity of niobium) and process conditions.

The preferred method of the present invention for forming accelerator structures with high quality factor and high accelerating gradients is the three dimensional (3D) machining of the half cells at a controlled low temperature to obtain a mirror-like (very smooth) finish so as to enable the resultant cavity to attain very high voltages without causing field emission. In the preferred method, the temperature of the machining process is carried out at a temperature of 100 K or less. In conventional machining of accelerator cavities, the machining process tends to make the niobium surface loaded with hydrogen which leads to hydride formation at the operating temperature, thereby reducing the quality factor. A critical advantage achieved by 3D machining at a temperature of 100 K or less is the reduction of the tendency of the niobium and hydrogen to react to form a hydride layer at the operating temperature on the inner surface of the cavity and enhancing the quality factor. A further step in the method is the monitoring of the surface roughness until the desired surface roughness is achieved. The machining is continued until the inner surfaces of the SRF cavities average less than 2 nm root mean square (RMS) roughness over a 1 $mm^2$ area. The surface roughness is measured using a surface profilimeter, which can be a stylus-type profilimeter or an optical profilimeter.

A critical advantage provided by the method of the present invention is the elimination of a damage layer and the subsequent chemical treatment to remove the damage layer, which the formation of a damage layer and the subsequent chemical treatment are typical steps in current production processes for SRF cavities. Chemical treatment invariably introduces hydrogen and other contaminants that need to be removed, typically by rinsing and baking the cavities at a high temperature. Thus the method of the present invention eliminates a substantial amount of processing steps currently required in the production of SRF cavities. The 3D machining of the current invention creates a smooth mirror-like surface on the inner surface of the SRF cavities without producing a damage layer, thus no subsequent processing to remove hydrogen and other contaminants is required.

In the present invention, 3D machining of the half cells at 100 K or less ensures removal of the hydrogen absorbed during the cavity half-cell forming process and accumulated on the surface as hydrides, which is easily machined away by the 3D machining. At 100 K or less, the percent elongation of niobium is at a minimum, which means that niobium turns less ductile and can be easily machined. As a result of the 3D machining at below 100 K, the finished cavities do not have to be baked at high temperatures. The method of the present invention enables production of an SRF cavity having an accelerating gradient ($E_{acc}$) of 45 MV/m or greater and a quality factor ($Q_0$) of $4\times10^{10}$ or greater.

The method of the present invention enables the use lower grades of niobium in place of the expensive high RRR (residual resistivity ratio) niobium used in present construction techniques. In producing a niobium accelerator cavity according to the invention, the properties of the lower grade niobium are evaluated to optimize the method steps in order to achieve high performance of the resultant accelerator structures. Most preferably, the thermal conductivity and specific heat options of the niobium would be identified using an appropriate testing instrument. One such instrument is the Physical Property Measurement System (PPMS®), available from Quantum Design, Inc. of San Diego, Calif.

With reference to FIG. 1, the method of forming a superconducting radio frequency (SRF) accelerator cavity includes the steps of:

(1) providing a half-cell 20 of an accelerator cavity, the half-cell 20 including an inner surface 22 and an equator 24;

(2) adjusting the temperature of the half-cell to 100 K or less;

(3) maintaining the half-cell 20 in an inert atmosphere;

(4) removing a thin layer of the inner surface 22 of the half-cell;

(5) measuring the roughness of the inner surface 22 of the half-cell 20 with a surface profilimeter; and (6) repeating steps (4) through (5), while maintaining the temperature of the half-cell at 100 K or less, until the inner surface 22 of the half-cell 20 is less than 2 nm root mean square (RMS) roughness over a 1 $mm^2$ area.

Figure 3:
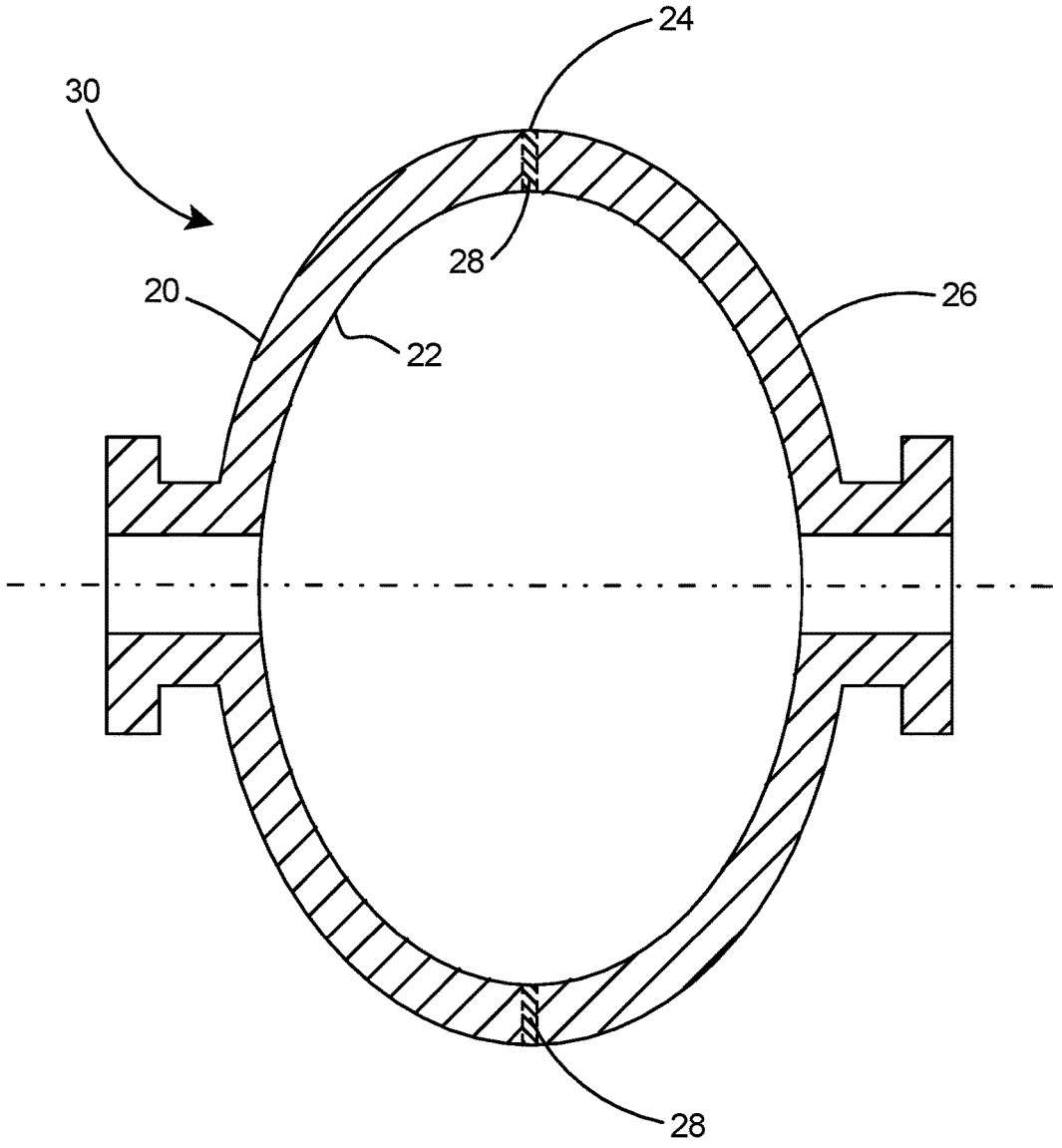
FIG. 3 is a sectional view of a superconducting radio frequency accelerator cavity according to the present invention.

Referring to FIG. 3, the method further includes forming a second half-cell 26 according to the steps listed hereinabove, and welding the two half-cells 20 and 26 together in an inert atmosphere to form a superconducting radio frequency accelerator cavity 30. The resultant SRF cavity includes an accelerating gradient ($E_{acc}$) of 45 MV/m or greater and a quality factor ($Q_0$) of $4\times10^{10}$ or greater. A substantial method of the present invention is that the method does not create hydrides on the inner surfaces of the half-cells, thereby negating the need for chemical scrubbing, rinsing, and subsequently baking at a high temperature to remove the hydrides.

The inert atmosphere established for the layer removal step and for welding is preferably a noble gas, which may include (Ar), helium (He), neon (Ne), krypton (Kr), xenon (Xe), and mixtures thereof. Most preferably, the inert atmosphere includes argon gas. In the layer removal step, the half-cell and the machinery for layer removal are carried out in an enclosed volume filled with a noble gas. In the welding step, the half-cells and the welder are carried out in an enclosed volume filled with a noble gas.

Figure 2:
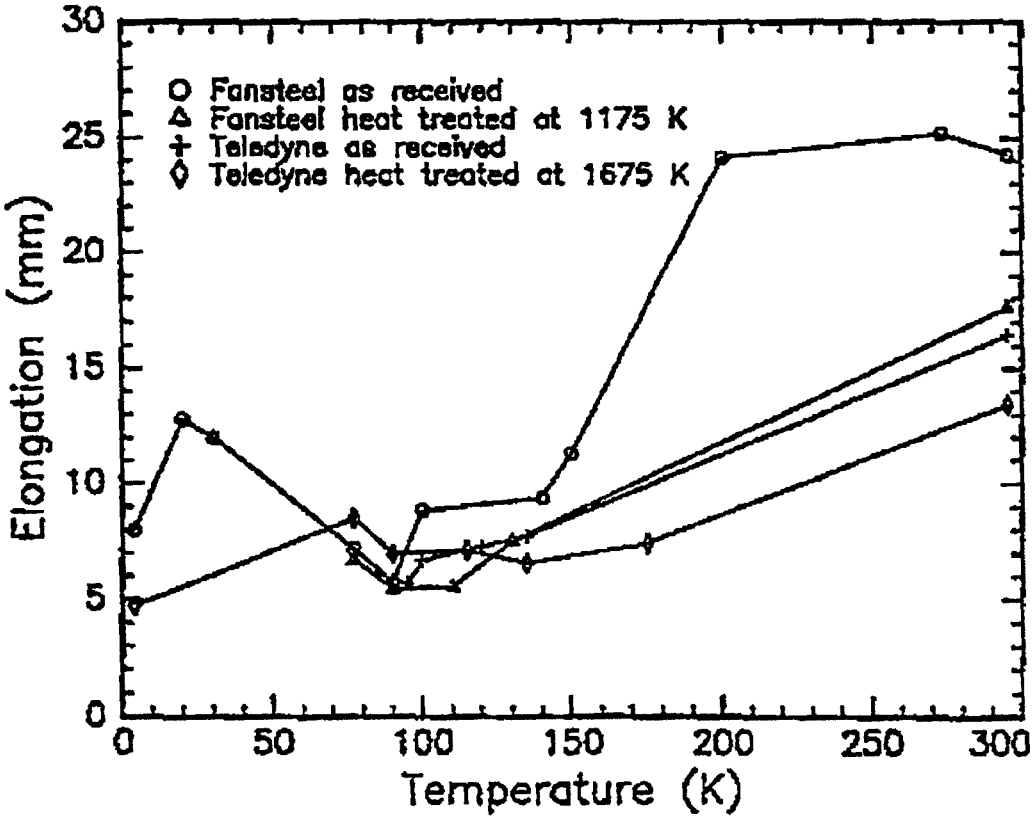
FIG. 2 is a plot of the elongation at break of niobium versus temperature.

With reference to FIG. 2, the graph illustrates the choice of maintaining the half-cells at a temperature of 100 K or less during the machining operation. As shown in FIG. 2, the percent elongation at break of various grades of niobium is at a minimum at a temperature of 100 K. This indicates that niobium turns less ductile at 100 K and can be more easily machined.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A chemical rinse-free method of forming a superconducting radio frequency (SRF) accelerator cavity, comprising:

(a) providing a first and second half-cell of an accelerator cavity having an inner surface and an equator;

(b) adjusting the temperature of the first and second half-cell to 100 K or less;

(c) removing a thin layer of the inner surface of the first and second half-cell while holding the temperature of the first and second half-cell to 100K or less and maintaining the first and second half-cell in a first inert atmosphere;

(d) measuring the roughness of the inner surface of the first and second half-cell with a surface profilimeter;

(e) repeating steps (c) through (d) until the inner surface of the first and second half-cell is less than 2 nm root mean square (RMS) roughness over a 1 $mm^2$ area; and (f) welding the two half-cells together in a second inert atmosphere to form a superconducting radio frequency accelerator cavity.

2. The method of claim 1 wherein said half-cells are constructed of niobium.

3. The method of claim 1 wherein said half-cells are constructed of material selected from the group consisting of niobium, copper, vanadium, titanium, technetium, steel, and alloys thereof.

4. The method of claim 1 wherein the accelerator cavity further comprises a quality factor ($Q_0$) of $4\times10^{10}$ or greater.

5. The method of claim 1 wherein the accelerator cavity further comprises an accelerating gradient ($E_{acc}$) of 45 MV/m or greater.

6. The method of claim 1 wherein the thin layer of the inner surface of the first and second half-cell is removed on a 3D milling machine.

7. The method of claim 1 wherein the second inert atmosphere is selected from the group comprised of argon (Ar), helium (He), neon (Ne), krypton (Kr), and xenon (Xe).

* * * * *